US005492039A

United States Patent [19]

Haikal et al.

[11] Patent Number: 5,492,039

[45] Date of Patent: Feb. 20, 1996

[54] THREADED OBJECT DRIVING TOOL AND METHOD

[75] Inventors: Najibullah Haikal, Newark; Walter R. Swift, Redwood City, both of Calif.

[73] Assignee: Harris Corporation, Melbourne, Fla.

[21] Appl. No.: 224,966

[22] Filed: Apr. 8, 1994

[51] Int. Cl.[6] ..... B25B 13/50

[52] U.S. Cl. ..... 81/53.2

[58] Field of Search ..... 81/53.2

[56] References Cited

U.S. PATENT DOCUMENTS

| | | | |
|---|---|---|---|
| 2,069,527 | 2/1937 | Kirkland | 81/53.2 |
| 2,522,817 | 9/1950 | Freer | 81/53.2 |
| 2,641,948 | 6/1953 | Braendel | 81/53.2 |
| 2,704,473 | 3/1955 | Walther | 81/53.2 |
| 2,790,342 | 4/1957 | Rosan | 81/53.2 |
| 3,368,430 | 2/1968 | Levering | 81/53.2 |
| 3,603,180 | 9/1971 | Alexander | 81/53.2 |
| 4,977,799 | 12/1990 | Yasutomi et al. | 81/53.2 |

*Primary Examiner*—Joseph M. Gorski
*Attorney, Agent, or Firm*—Rogers & Killeen

[57] ABSTRACT

A tool and method for threading a stud into a workpiece. The tool has a shaft and a nosepiece which is threaded onto the shaft. The nosepiece has a set of threads which engage the threads of a stud to be inserted into a workpiece. When the nosepiece has been threaded far enough onto the end of the stud for the end of the shaft to contact the end of the stud, the engagement of the stud by both the nosepiece and the shaft rotationally latches the tool to the stud. The tool can then be rotated in the insertion direction to cause the stud to be threaded into a workpiece. Rotation of the shaft in the withdrawal direction causes the end of the shaft to disengage from the end of the stud, thereby removing the rotational latch between the tool and the stud so that further rotation of the tool in the withdrawal direction causes the nosepiece to be threaded off the end of the stud without rotation of the stud in the withdrawal direction.

11 Claims, 1 Drawing Sheet

THREADED OBJECT DRIVING TOOL AND METHOD

BACKGROUND OF THE INVENTION

The invention relates to tools and methods of inserting threaded objects, such as studs or connectors, into a workpiece. The threaded object to be inserted is typically a shaft which has external threads along its entire length. Usually one end of the threaded object is to be driven into the workpiece and the other end of the threaded object is to extend above the workpiece so that other objects can thereafter be threaded onto the protruding end of the threaded object.

The rotation of threaded objects in the withdrawal direction as the tool is removed therefrom is a problem, particularly for connectors threaded into thin film enclosures.

The prior art contains a variety of different tools having fingers which grasp the threaded object and cause the threaded object to rotate with the tool. To use this type of tool the tool is placed over the end of the object, the fingers are made to engage the object, and the tool is rotated in the insertion direction to thread the object into a workpiece. After the object has been fully inserted, the fingers are made to release the object so that the tool can be removed from the end of the object without reverse rotating the tool or the object. Examples of such tools can be seen in the Shinn U.S. Pat. No. 3,413,876, and the McKean U.S. Pat. No. 4,513,643.

Such tools are often mechanically complex, subject to frequent breakdown, and are expensive to produce. In addition, the fingers of such tools must be soft enough to avoid damage to the threads of the threaded object, tend to wear quickly and require periodic replacement.

Less mechanically complex tools which have a receptacle with interior threads are placed over the end of the threaded object and threaded onto the end of the object until the end of the object contacts the end of the receptacle. The tool may then be rotated in the insertion direction to thread the object into a workpiece. Once the object has been fully inserted the tool is rotated in the reverse direction to unthread the tool from the end of the object. An example of this type of tool is described in U.S. Pat. No. 4,982,625 to Bonner.

However, the force which is used to drive the object into the workpiece often causes the tool to become tightly attached to the end of the object. Once the object has been fully inserted in the workpiece, the frictional forces which hold the tool to the end of the object may be difficult to overcome and, when the tool is rotated in the reverse direction to remove it from the end of the object, the friction bond tends to cause the object to rotate in the reverse direction.

It is accordingly an object of the present invention to obviate the problem of the known prior art tools and to provide a novel, inexpensive, simple-to-produce tool which may be used to insert a threaded object into a workpiece and thereafter removed from the threaded object without the application of significant reverse rotating force to the threaded object.

It is a further object of the present invention to provide a novel tool and method of inserting a threaded object into a workpiece by simple forward and reverse rotation of the tool.

It is still a further object of the present invention to provide a novel tool and method to drive a connector into a thin film enclosure and leave the connector at its fully inserted position, so that minimal electrical insertion losses are experienced in the connector.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

Figure 1:
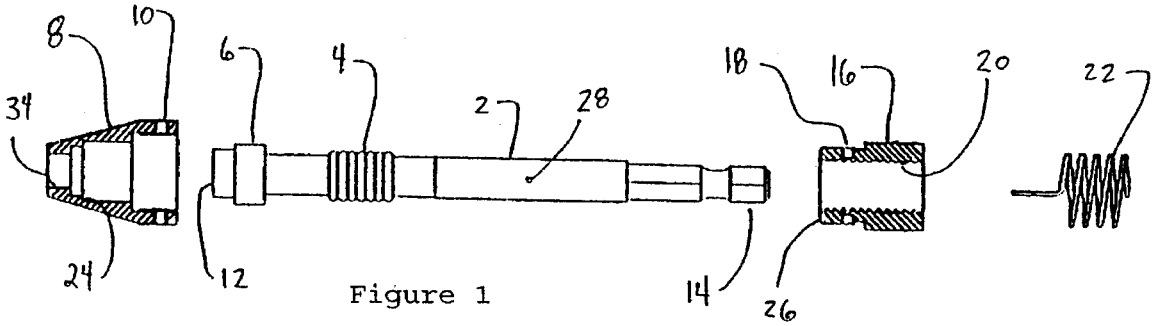
FIG. 1 is an exploded view in elevation of one embodiment of the tool of the present invention wherein the elements which comprise the nosepiece are shown in cross-section.
Figure 2:
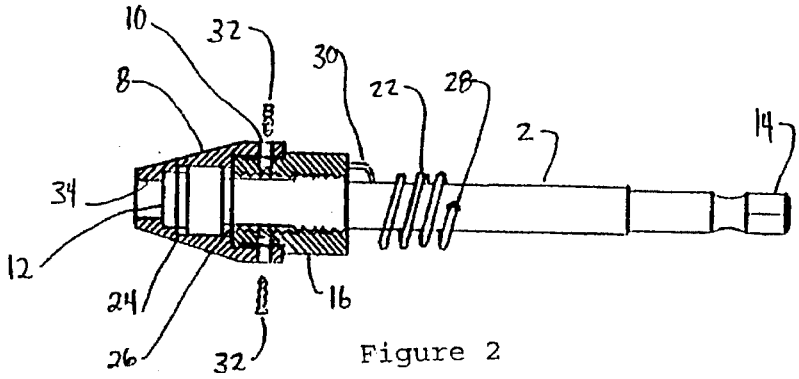
FIG. 2 shows the assembly of the tool of FIG. 1.

With reference to the embodiment of the present invention shown in FIGS. 1 and 2, the tool may comprise a central shaft 2, a nosepiece comprising a rear section 16 and a forward section 8, and a spring 22 which connects the shaft 2 to the rear section 16 of the nosepiece.

The shaft 2 has a rear end 14 which is adapted to be driven by a wrench or suitable power driver such as a drill. The forward end 12 of the shaft 2 comes into contact with the end of the threaded object upon the rotation of the tool onto the object. External threads 4 are provided along the shaft 2, towards the forward end thereof, to mate with internal threads 20 on the rear section 16 of the nosepiece. A raised circumferential ring 6 is located forward of the threads 4.

The forward section 8 of the nosepiece may be provided with threaded holes 10 positioned to align with threaded holes 18 on the rear section 16 of the nosepiece. The forward section 8 of the nosepiece has a threaded aperture 34 adapted to mate with the threads of the threaded object to be driven into a workpiece. The rear section 16 of the nosepiece has interior threads 20 which mate with the threads 4 of the shaft 2.

To assemble the tool, the forward section 8 of the nosepiece is placed over the forward end 12 of the shaft 2. The rear section 16 of the nosepiece is placed over the rear end 14 of the shaft 2, moved toward the forward end 12 of the shaft 2, and threaded onto the threads 4 of the shaft 2. The forward section 8 of the nosepiece and the rear section 16 of the nosepiece may be fastened together using set screws 32 threaded into the threaded holes 10 of the front section 8 of the nosepiece and the threaded holes 18 of the rear section 16. Other suitable conventional means of fastening the forward and rear sections together may be used.

A spring 22 may then be fitted over the shaft 2 and one end of the spring 30 inserted into the rear section 16 of the nosepiece and the other end of the spring inserted into an aperture 28 in the shaft 2. The spring 22 limits the rotation of the nosepiece relative to the shaft 2, but permits the relative free initial rotation thereof.

In use, a threaded object, such as a stud or connector, may be threaded into the threaded aperture 34 of the forward section 8 of the nosepiece until the end of the threaded object contacts the forward end 12 of the shaft 2. At this point the threaded object, which has been engaged by the threads 34 of the forward section 8 of the nosepiece and the forward end 12 of the shaft 2, is rotationally latched to the tool. The tool may then be rotationally driven in an insertion direction to insert the threaded object into a workpiece.

Once the threaded object has been fully inserted into a workpiece, the shaft 2 of the tool may be rotated in the reverse direction to remove the tool from the end of the threaded object.

When the shaft 2 is first rotated in the reverse direction, the shaft 2 will move axially with respect to the nosepiece and the threaded object due to the threads 4 of the shaft 2 which are mated with the interior threads 20 of the rear section 16 of the nosepiece. This axial movement of the shaft 2 will cause the forward end 12 of the shaft 2 to move out of contact with the end of the threaded object. After the forward end 12 of the shaft 2 has disengaged from the end of the threaded object, the tool will no longer be rotationally latched to the threaded object and further reverse rotation of the shaft 2 will cause the nosepiece to become rotationally latched to the shaft 2. Once the latch between the nosepiece and the shaft 2 is achieved, further reverse rotation of the shaft will cause the nosepiece to unthread off of the end of the threaded object. Since the rotational latch between the tool and the threaded object is removed before the nosepiece is rotated in the reverse direction, the threaded object is left in the fully inserted position.

Once the shaft 2 moves axially with respect to the nosepiece during the initial reverse rotation of the shaft 2, the rotational latch between the tool and the threaded object is removed. It is then necessary for the shaft 2 to become rotationally latched to the nosepiece so that further reverse rotation of the shaft 2 will cause the nosepiece to unthread from the threaded object. This rotational latch between the shaft 2 and the nosepiece can be provided by any suitable conventional means.

In one embodiment, the nosepiece may be latched to the shaft 2 during reverse rotation of the shaft 2 by a circumferential ring 6 on the shaft 2 which contacts pressure shoulders 24 and 26 on the interior of the nosepiece. When the shaft 2 is rotated in the reverse direction, the shaft 2 will move axially with respect to the nosepiece until the circumferential ring 6 of the shaft 2 contacts the pressure shoulder 26. At that point the shaft 2 will be rotationally latched to the nosepiece and further reverse rotation of the shaft 2 will cause the entire tool to reverse rotate.

Alternatively, a spring means is used to latch the nosepiece to the shaft 2. If the spring 22 is compressed during insertion of the threaded object, the free withdrawal of the shaft relative to the nosepiece may be aided by spring 22. Removal of the forward rotating force would permit the spring to counter rotate the shaft relative to the nosepiece while tending to hold the nosepiece motionless.

In addition, the reverse rotation of the shaft may cause energy to be stored in the spring 22. During this initial rotation of the shaft 2 the shaft 2 will move axially with respect to the nosepiece, removing the rotational latch between the tool and the threaded object. When enough energy has been stored in the spring 22 to overcome the inertia of the nosepiece and the friction between the interior threads 34 of the forward section 8 of the nosepiece and the threads on the threaded object, the nosepiece will begin to reverse rotate and will unthread off the object.

The spring has an advantage over the circumferential ring and pressure shoulders since the spring means permits the counter-rotational force on the nosepiece to build up more slowly in response to the actual rotation of the shaft 2. The spring thus may act as a clutch which allows the rotational speed of the nosepiece to gradually match the rotational speed of the shaft 2, thus reducing the tendency of the nosepiece to reverse rotate the threaded object.

Figure 3:
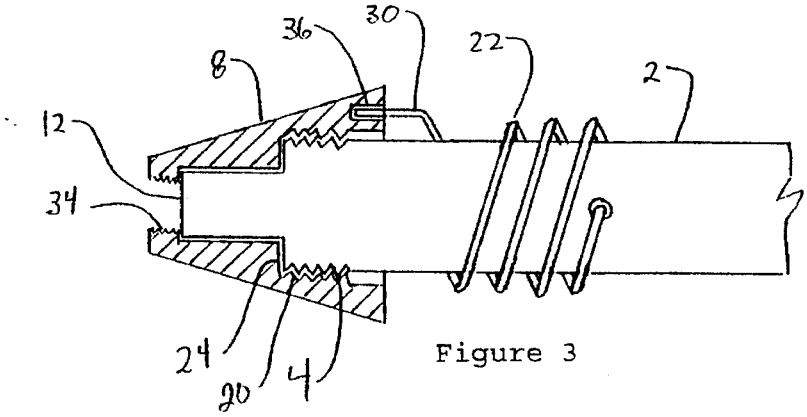
FIG. 3 is an elevation of the forward section of a second embodiment of the tool of the present invention with the nosepiece in cross-section.

A second embodiment of the tool of the present invention is shown in FIG. 3 where a unitary nosepiece 8 has interior threads 34 which engage the threads of the threaded object to be inserted into a workpiece. The interior threads 34 of the nosepiece 8 have a smaller diameter than the forward end 12 of the shaft 2. This embodiment may also include a spring 22 which (a) tends to destroy the frictional lock between shaft, nosepiece, and the threaded object and (b) latches the shaft 2 to the nosepiece during reverse rotation of the shaft 2.

In operation, the threaded object may be threaded into the interior threads 34 of the nosepiece 8 until the end of the threaded object contacts the forward end 12 of the shaft 2. The tool and the threaded object are then rotated in the insertion direction to insert the threaded object into a workpiece. Once the threaded object has been fully inserted, the shaft 2 is rotated in the reverse direction. The initial reverse rotation of the shaft 2 will cause the shaft 2 to move axially with respect to the nosepiece 8 and will cause the forward end 12 of the shaft 2 to disengage from the end of the threaded object.

Figure 4:
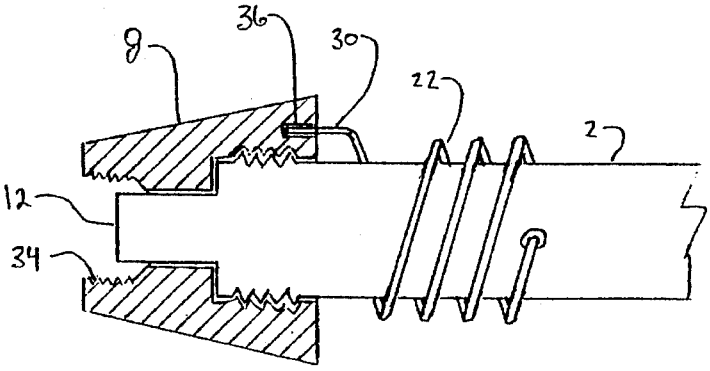
FIG. 4 is an elevation of the forward section of a third embodiment of the tool of the present invention with the nosepiece in cross-section.

A third embodiment of the tool of the present invention is shown in FIG. 4 where the interior threads 34 of the nosepiece 8, which engages the threaded object, have a larger diameter than the forward end 12 of the shaft 2.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. In a two piece tool for threading a stud into a workpiece, said tool engaging the threads of the stud as well as the end of the stud to rotationally latch the tool to the stud for threading the stud into a workpiece by forward rotation of the rear section of the tool, the improvement:

wherein a forward section engages the threads of the stud and said rear section engages the end of the stud; and wherein said tool includes:

means for moving said rear section axially with respect to said forward section, away from the end of the stud, by reverse rotation of said rear section relative to said forward section, thereby disengaging said rear section from the end of the stud and unlatching the tool from the stud, means operatively connected to the rear section and forward section for rotationally biasing said rear section relative to said forward section so that the forward section tends to remain motionless when the rear section is rotated in the reverse direction to unlatch the tool from the stud, and means for rotationally latching said forward section to said rear section such that further reverse rotation of said rear section causes said forward section to rotate in the reverse direction and thereby disengage the threads of the stud.

2. A tool for threading an object into a workpiece comprising:

a forward section adapted at the forward end thereof to engage a first portion of the object to be threaded into the workpiece;

a rear section adapted at the rear end thereof to be rotationally driven and adapted at the forward end thereof to engage a second portion of the object to be threaded into the workpiece, the engagement of the object by both of said sections providing a rotational latch between the tool and the object, means for causing said rear section to move axially to engage the second portion of the object after the object has been engaged by said forward section so that rotation of the rear section in the insertion direction effects the rotation of the tool and the threading of the object into the workpiece, said means being responsive to the rotation of said rear section in the withdrawal direction to axially move said rear section relative to said forward section without rotating said forward section to thereby disengage said rear section from the object and thus unlatch the tool from the threaded object; and means operatively connected to the forward section and rear section for rotationally biasing said forward section relative to said rear section so that the forward section tends to remain motionless when the rear section is rotated in the withdrawal direction to unlatch the tool from the object.

3. The tool of claim 2 further comprising:

means for latching said rear section to said forward section when said rear section is rotated in the withdrawal direction such that continued rotation of said rear section in the withdrawal direction causes said forward section to disengage the threaded object without rotation of the threaded object.

4. A tool for threading a threaded object into a workpiece comprising:

a nose section having a first set of threads at the forward end thereof which mate with the threads of the threaded object such that the nose section may be threaded onto the object, said nose section having a second set of threads at the rear end;

a shaft configured at the rear end thereof to be rotationally driven and having threads intermediate the length thereof so that said shaft and said nose section may be threaded together, said shaft being configured at the forward end thereof to abut the end of the threaded object such that when (a) said shaft and said nose section are threaded together and (b) when said nose section has been threaded onto the object, abutment of said shaft with the end of the object limits the distance said nose section can be threaded onto the object, thus enabling the tool to be latched to the object when the shaft is rotated in an insertion direction and unlatched from the object when the shaft is rotated in a reverse direction; and means operatively connected to the nose section and shaft for rotationally biasing said nose section relative to said shaft so that the nose section tends to remain motionless when the shaft is rotated in the reverse direction to unlatch the tool from the object.

5. The tool of claim 4, further comprising:

means carried by said nose section and said shaft for limiting the distance said shaft can be withdrawn from said nose section without rotationally latching said nose section and said shaft.

6. A tool for threading an object into a workpiece comprising:

a forward section adapted at the forward end thereof to engage a first portion of the object to be threaded into the workpiece;

a rear section adapted at the rear end thereof to be rotationally driven and adapted at the forward end thereof to engage a second portion of the object to be threaded into the workpiece, the engagement of the object by both sections providing a rotational latch between the tool and the object; and means responsive to the rotation of said rear section for selectively varying the relative axial position of said forward and rear sections between (a) a first axial position at which said rear section is abutting the object such that the tool is latched to the object and rotation of said rear section in the insertion direction will effect the driving of said forward section and the object, and (b) a second axial position at which said forward and rear sections are latched together so that rotation of said rear section in the withdrawal direction will unlatch said forward section and thus the tool from the threaded object, and means operatively connected to said forward section and rear section for rotationally biasing the forward section relative to the rear section so that the forward section tends to remain motionless when the rear section is rotated in the withdrawal direction to unlatch the tool from the object.

7. A tool for threading an object into a workpiece comprising:

a forward section adapted at the forward end thereof to engage a first portion of the object to be threaded into the workpiece;

a rear section adapted at the rear end thereof to be rotationally driven and adapted at the forward end thereof to engage a second portion of the object to be threaded into the workpiece, the engagement of the object by both sections providing a rotational latch between the tool and the object;

means responsive to the rotation of said rear section for selectively coupling said forward and rear sections together in a way which prevents axial movement therebetween and effects rotational movement to said forward section; and means operatively connected to said forward section and rear section for rotationally biasing the forward section relative to the rear section so that the forward section tends to remain motionless when the rear section is rotated in a withdrawal direction to unlatch the tool from the object.

8. The tool of claim 7 further comprising means for causing said rear section to move axially with respect to said forward section when said rear section is rotated relative to said forward section.

9. The tool of claim 8 wherein said means for causing said rear section to move axially with respect to said forward section comprises:

a first set of threads on said rear section, and a second set of threads on said forward section which mate with said first set of threads.

10. The tool of claim 9 wherein said means for selectively coupling said forward and rear sections together for rotational movement comprises:

a raised circumferential ring of material on said rear section, and first and second pressure shoulders on said forward section which contact said circumferential ring so that said forward and rear sections are coupled for rotation when the circumferential ring contacts said first or second pressure shoulders.

11. In a tool for threading a stud into a workpiece and removing the tool from the stud without unthreading the stud from the workpiece, said tool having a forward section for engaging the threads of the stud as well as a rear section for rotationally latching the tool to the end of the stud by rotation of the rear section of the tool relative to the forward section, the improvement comprising:

means operatively connected to the rear section and the forward section for rotationally biasing said rear section relative to said forward section so that the forward section tends to remain motionless when the rear section is rotated in a reverse direction to unlatch the tool from the stud.

* * * * *